US005174127A

United States Patent [19]

Harper et al.

[11] Patent Number: 5,174,127

[45] Date of Patent: Dec. 29, 1992

[54] SUCTION MUFFLER TUBE

[75] Inventors: Harold M. Harper, Brooklyn; Ronald K. Harper; Tara C. Kandpal, both of Tecumseh, all of Mich.

[73] Assignee: Tecumseh Products Company, Tecumseh, Mich.

[21] Appl. No.: 612,138

[22] Filed: Nov. 13, 1990

[51] Int. Cl.[5] ..... F25D 19/00; F04B 39/00; F04B 21/00

[52] U.S. Cl. ..... 62/296; 417/312; 181/403

[58] Field of Search ..... 62/296; 181/403; 417/312-313; 285/7, 9.2, 239, 260, 399

[56] References Cited

U.S. PATENT DOCUMENTS

| | | | |
|---|---|---|---|
| 1,025,759 | 5/1912 | McCluskey . | |
| 2,650,114 | 8/1953 | Epstein | 285/185 |
| 2,712,950 | 7/1955 | Siebert | 285/161 |
| 3,066,857 | 12/1962 | McCloy | 181/403 X |
| 3,066,959 | 12/1962 | White | 285/399 |
| 3,781,941 | 1/1974 | MacFarland | 15/339 |
| 3,864,064 | 2/1975 | Gannaway | 417/312 |
| 3,948,546 | 4/1976 | Welsby et al. | 285/239 |
| 3,950,014 | 4/1976 | Doubleday | 285/7 |
| 3,989,280 | 11/1976 | Schwarz | 285/239 X |
| 4,239,461 | 12/1980 | Elson | 417/312 |
| 4,352,642 | 10/1982 | Murayama et al. | 417/312 |
| 4,370,104 | 1/1983 | Nelson et al. | 417/312 |
| 4,371,319 | 2/1983 | Murayama et al. | 417/312 |
| 4,396,389 | 8/1983 | Kropiwnicki | 62/296 X |
| 4,401,418 | 8/1983 | Fritchman | 417/312 |
| 4,411,600 | 10/1983 | Itagaki et al. | 416/312 |
| 4,412,791 | 11/1983 | Lal | 417/312 |
| 4,415,060 | 11/1983 | Bar | 181/272 |
| 4,428,602 | 1/1984 | Lambot et al. | 285/239 |
| 4,477,229 | 10/1984 | Kropiwnicki et al. | 417/53 |
| 4,573,880 | 3/1986 | Hirano et al. | 417/312 |
| 4,573,881 | 3/1986 | Romer | 417/312 |
| 4,582,468 | 4/1986 | Bar | 181/403 X |
| 4,755,108 | 7/1988 | Todescat et al. | 417/312 |
| 4,759,693 | 7/1988 | Outzen | 417/312 |
| 4,779,902 | 10/1988 | Lee | 285/260 |
| 4,784,581 | 11/1988 | Fritchman | 417/312 |
| 4,784,583 | 11/1988 | Bar | 417/312 |
| 4,793,775 | 12/1988 | Peruzzi | 417/312 |

*Primary Examiner*—Henry A. Bennet
*Assistant Examiner*—Christopher B. Kilner
*Attorney, Agent, or Firm*—Baker & Daniels

[57] ABSTRACT

A muffler tube for use in a hermetically sealed compressor is disclosed. The muffler tube of the present invention has a roughened outer finish, and has a protuberance extending radially outwardly therefrom, which protuberance is received in a recess in the inner wall of the muffler. The combination of the roughened outer finish and the protuberance connection assist in preventing the muffler from turning on the tube, and from moving vertically on the tube.

6 Claims, 1 Drawing Sheet

SUCTION MUFFLER TUBE

BACKGROUND OF THE INVENTION

This invention relates generally to hermetic compressors for use in refrigeration systems such as air conditioners and the like, and more particularly to compressors wherein one or more mufflers are provided in order to reduce the noise generated during the operation of the compressor.

Typical refrigeration compressors are used in a wide variety of small appliances, including many commonly used in the home, such as refrigerators, heat pumps and the like. In normal operation, these compressors utilize a reciprocating piston which operates at a relatively high speed. As a result, a relatively high frequency series of pulses for both the suction portion of the piston stroke and the discharge portion of the piston stroke are generated. Because of the noise generated by these pulsations, it has been common to provide separate mufflers at both the suction and discharge of the compression cylinder in order to dampen these pulsations, and minimize the noise generated therefrom.

In general, hermetic compressor assemblies of the type to be described herein comprise a hermetically sealed housing having a compressor mechanism mounted therein. The compressor mechanism includes a cylinder block defining a compression chamber therein in which gaseous refrigerant is compressed and subsequently discharged. In a typical system, elongated suction inlet tubing and a suction muffler may be provided for the purpose of reducing noise generated by the operation of the intake valving of the compressor. Gaseous refrigerant from a suction accumulator flows into the compressor assembly through a suitable suction inlet and, thereafter, into the suction muffler. From there, the refrigerant is passed through a tube and into a suction chamber enclosed by the cylinder head. The refrigerant is then drawn into the cylinders by the reciprocating action of the pistons. After the refrigerant has been compressed in the cylinder, the refrigerant exits the cylinder head through a discharge chamber and discharge muffler. Thereafter, it is carried outside the housing through a discharge outlet tube and is directed to the system condenser. The present invention relates generally to a tube that is used to connect the suction muffler to the suction chamber of the cylinder head.

In recent years, it has become common to produce suction mufflers from a plastic material. Frequently, the connection between the muffler and the tube is not secure. As a result, the muffler may become disengaged from the tube. Also, the pulsations in the muffler may cause the muffler to turn radially, or to move vertically on the tube. Prior art tubes have had a smooth outer finish, and have included a flattened portion which was sized to match a reciprocal flattened portion in the muffler. Although this connection is sufficient to maintain the connection between the tube and the muffler in some operations, nevertheless, the unreliability of the connection has often led to a malfunctioning of the compressor.

It is desired to provide a muffler tube wherein a secure connection between the muffler and the tube is provided so that the muffler will not become detached from the tube during normal operation of the compressor. Further, it is desired to provide a suction muffler tube that operates to secure the muffler to the tube, so that the muffler will not turn radially or move vertically on the tube during use of the appliance.

SUMMARY OF THE INVENTION

The present invention overcomes the disadvantages of the prior art by providing an improved muffler tube for connection to the mufflers in the compressor assembly. The muffler tube of the present invention has a roughened outer surface, and a dimple extending radially outwardly from the outer surface of the tube. The dimple is received in a recess in a wall of the passageway through which the refrigerant travels through the muffler. The combination of the roughened outer surface of the tube and the dimpled connection prevent the muffler from turning on the tube, and from moving vertically on the tube.

The invention, in one form thereof, provides a muffler tube for joining a muffler to a compressor unit in a hermetic compressor, wherein the tube has an opening at each axial end thereof, and has a roughened outer surface. Either the outer surface of the tube or an inner surface of the muffler has at least one protuberance extending radially therefrom. The protuberance is adapted to be received in a corresponding recess in the other of the tube outer surface or muffler inner surface so that the muffler is secured to the tube.

The invention, in accordance with one form thereof, provides a hermetic compressor assembly comprising an outer housing defining an interior space, a suction muffler within the housing having an inner passageway which is in fluid communication with refrigerant at suction pressure whereby the refrigerant can flow through the passageway, a compressor mechanism positioned within the housing for compressing the refrigerant, and a muffler tube having openings at each of its axial ends. The compressor mechanism includes a cylinder head having a suction chamber for receiving the refrigerant from the muffler. One of the axial ends of the tube is joined with the suction muffler at the inner passageway, the other of the axial ends is joined with the suction chamber whereby the refrigerant passes through the tube from the muffler inner passageway to the suction chamber. The tube has a roughened outer surface, and also includes a flattened portion. The flattened portion is sized and configured to mate with a flattened portion on a surface of the muffler inner passageway when the tube and the muffler are joined. The outer surface has a dimple extending radially outwardly therefrom, which dimple is received in a recess in the surface of the passageway.

One advantage of the present invention is that it provides an improved muffler tube that secures the muffler to the tube so that the muffler will not turn radially or move vertically on the tube during operation of the compressor assembly.

Another advantage of the present invention is that it provides a very simple and economical means for effectively connecting the muffler to the muffler tube.

A further advantage of the present invention is that it provides a very reliable connection between the muffler and the tube, thereby improving the operation of the compressor and reducing the possibility of malfunction of the compressor.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
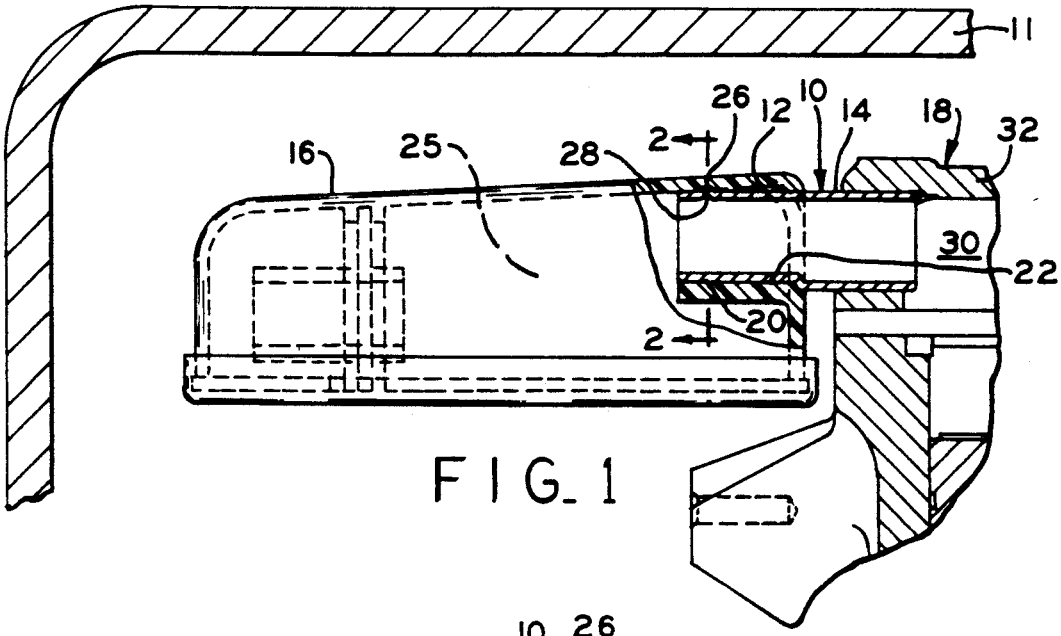
FIG. 1 shows in full section the suction muffler tube of the present invention, showing one end of the tube connected to a suction muffler, and showing the other end connected to a suction chamber of the compressor.
Figure 2:
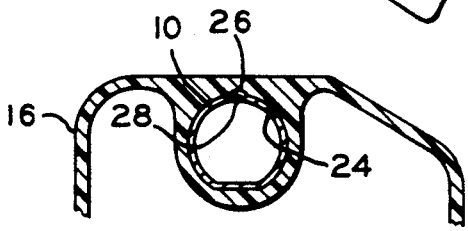
FIG. 2 is a sectional view of the tube and muffler of FIG. 1 taken along the line of 2—2 in FIG. 1 and viewed in the direction of the arrows.

Referring to the drawings, and particularly to FIG. 1, a suction muffler tube according to the present invention is shown. Suction muffler tube 10 is attached at end portions 12, 14 to suction muffler 16 and compressor 18, respectively. Muffler 16 and compressor 18, disposed within compressor housing 11, are conventional in nature, and operate in a conventional manner well known to those of ordinary skill in the art.

Figure 3:
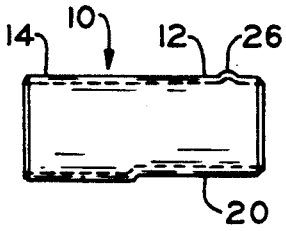
FIG. 3 is a side elevational view of the suction muffler tube of FIG. 1.
Figure 4:
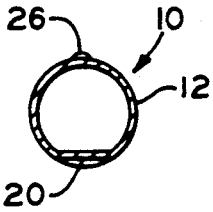
FIG. 4 is an end view of the suction muffler tube shown in FIG. 3.

As best shown in FIGS. 3 and 4, suction muffler tube 10 has a generally cylindrical body, which includes end portions 12,14. A flattened portion 20 is formed on an underside of cylindrical portion 12. Flattened portion 20 is sized and configured to engage a mating flattened portion 22 in passageway 24 of muffler 16. Passageway 24 is in communication with a muffler chamber 25 that is open to the interior of housing 11. An inlet (not shown) connects the interior of the housing to incoming gaseous refrigerant.

Tube 10 includes at least one protuberance 26 projecting radially outwardly from its outer surface. Preferably, protuberance 26 has a shape similar to that of a dimple, and is positioned on the outer surface of tube portion 12, diametrically opposite flattened portion 20. When tube 10 is engaged with muffler 16, protuberance 26 engages recessed portion 28, which is recessed into a wall of muffler passageway 24. Preferably, suction muffler 16 is formed of a plastic material. Recessed portion 28 may be formed by heating muffler 16, and then allowing the heated muffler to cool around tube 10 and protuberance 26. Muffler 16 shrinks as it cools, thereby forming the recess in muffler 16, and forms a shrink fit with tube 10. This method of forming recessed portion 28 is simple and convenient, and enables recessed portion 28 to be sized and configured to match very favorably with protuberance 26. The engagement between protuberance 26 and recessed portion 28 assists in securing muffler 16 to tube 10, so that muffler 16 will not turn radially or move vertically on tube 10. Although it is preferred to position protuberance 26 on the outer surface of tube portion 12 directly opposite flattened portion 20 as shown in the drawings, other arrangements are also acceptable. In addition, it is possible to have more than one protuberance spaced at discrete positions on the outer surface of portion 12. With this latter arrangement, it is necessary to provide a corresponding number of recessed portions suitably positioned in the wall of muffler passageway 24. It is also possible to have a protuberance extending radially inwardly from the wall of passageway 24, wherein a corresponding recess would be positioned on a corresponding portion of tube portion 12 to receive this protuberance.

As shown in FIG. 1, end portion 14 extends into suction chamber 30, enclosed by cast iron cylinder head 32. Tube portion 14 may be welded or brazed to head 32.

Figure 5:
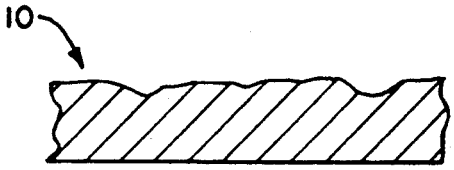
FIG. 5 is a highly magnified view showing the roughened outer surface of the suction muffler tube shown in FIG. 3.

The outer surface of muffler tube 10 has a roughened finish, as illustrated in the highly enlarged view shown in FIG. 5. This roughened finish is preferably obtained by shot blasting the entire outer surface of tube 10, so that a rough finish having ridges approximately 200–300 microinches high is obtained. Other well known methods of roughening a surface may likewise be substituted. Likewise the surface may be roughened to other depths, as long as the roughened surface has a relatively high coefficient of friction in order to provide a "gripping" action so that tube 10 is securely held to the inner surface of muffler passageway 24.

In a preferred embodiment, suction muffler tube 10 has a length of approximately 1.427 to 1.447 inch. Flattened portion 20 of tube 10 has a length of approximately 0.74 to 0.78 inch. Preferably, protuberance, or "dimple", 26 extends radially outwardly from the outer surface of tube portion 12 a distance of approximately 0.03 to 0.04 inch. Tube portion 4 has a diameter of approximately 0.622 to 0.625 inch, and tube flattened portion 12 has a diameter of approximately 0.590 to 0.595 inch in the direction perpendicular to flat 20. Passageway 24 of muffler 16 has a diameter of 0.545 to 0.565 inch. The exact dimensions of the muffler tube are necessarily dependent upon the particular sizes of the related components of the particular compressor and muffler utilized in the hermetic compressor unit, and may be varied as required. The above dimensions are suitable, however, for a given application. Muffler 16 can be made of a suitable thermoplastic, such as VALOX. Tube 10 may be made of welded steel, as is conventional in hermetic compressors.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a hermetic compressor, a device joining a muffler to a compressor unit, comprising:

a tube having an opening at each axial end thereof, said tube having an outer surface roughened sufficiently to provide a gripping action between said tube and the muffler, said surface is roughened to a finish of 200 to 300 microinch, one of said tube outer surface in inner surface of said muffler having at least one protuberance extending radially therefrom, said protuberance being received in a corresponding recess and the other of said tube outer surface and muffler inner surface so that said muffler is secured to said tube.

2. A hermetic compressor assembly comprising:

an outer housing defining an interior space;

a suction muffler within aid housing, said suction muffler having an inner passageway, said passageway being in fluid communication with refrigerant at suction pressure whereby said refrigerant can flow through said passageway;

a compressor mechanism positioned within said housing for compressing said refrigerant, said compressor mechanism including a cylinder having a suction chamber for receiving said refrigerant from said muffler; and a tube having openings at each axial end thereof, one of said axial ends being joined with said suction muffler at said inner passageway, the other of said axial ends being joined with said suction chamber whereby refrigerant passes through said tube from the inner passageway of said muffler to said suction chamber, said tube having a roughened outer surface, said outer surface roughened to a finish of 200 to 300 microinch, said outer surface including a flattened portion, said flattened portion being sized and configured to mate with a reciprocal flattened portion on a surface of said muffler inner passageway when said tue is joined with said muffler, said outer surface further having a dimple extending radially outwardly a distance of 0.03 to 0.04 inch therefrom, said dimple being received in a recess in said passageway surface and positioned on the outer surface diametrically opposite said flattened portion.

3. The hermetic compressor assembly of claim 2, wherein said outer surface is roughened by slot blasting.

4. In a hermetic compressor, a device joining a muffler to a compressor unit, comprising:

a tuber having an opening at each axial end thereof, said tube having an outer surface roughened by shot blasting to a finish of 200 to 300 microinch, one of said tube outer surface and an inner surface of said muffler having at least one protuberance extending radially therefrom, said protuberance being received in a corresponding recess in the other of said tube outer surface and muffler inner surface so that said muffler is secured to said tube.

5. A hermetic compressor assembly comprising:

an outer housing defining an interior space;

a suction muffler within said housing, said suction muffler having an inner passageway, said passageway being in fluid communication with refrigerant at suction pressure whereby said refrigerant can flow through said passageway;

a compressor mechanism positioned within said housing for compressing said refrigerant, said compressor mechanism including a cylinder having a suction chamber for receiving said refrigerant from said muffler; and a tube having openings at each axial end thereof, one of said axial ends being joined with said suction muffler at said inner passageway, the other of said axial ends being joined with said suction chamber whereby refrigerant passes through said tube from the inner passageway of said muffler to said suction chamber, said tube having an outer surface roughened to a finish of 200 to 300 microinch, said outer surface including a flattened portion, said flattened portion being sized and configured to mate with a reciprocal flattened portion on a surface of said muffler inner passageway when said tube is joined with said muffler, said outer surface further having a dimple extending radially outwardly therefrom a distance of from 0.03 to 0.04 inch, said dimple being positioned diametrically opposite said flattened portion and being received in a recess in said passageway surface.

6. The hermetic compressor assembly of claim 5, wherein said outer surface is roughened by shot blasting.

* * * * *